US009125790B2

(12) United States Patent
Van Gerpen

(10) Patent No.: US 9,125,790 B2
(45) Date of Patent: Sep. 8, 2015

(54) SYSTEM AND METHOD FOR ALLEVIATING FREEZING GAIT AND GAIT HYPOKINESIA IN USERS WITH EXTRAPYRAMIDAL DISORDER

(75) Inventor: Jay A. Van Gerpen, Jacksonville, FL (US)

(73) Assignee: MAYO FOUNDATION FOR MEDICAL EDUCATION AND RESEARCH, Rochester, MN (US)

( * ) Notice: Subject to any disclaimer, the term of this patent is extended or adjusted under 35 U.S.C. 154(b) by 107 days.

(21) Appl. No.: 13/637,718

(22) PCT Filed: Apr. 12, 2011

(86) PCT No.: PCT/US2011/032051

§ 371 (c)(1),
(2), (4) Date: Sep. 27, 2012

(87) PCT Pub. No.: WO2011/130223

PCT Pub. Date: Oct. 20, 2011

(65) Prior Publication Data

US 2013/0014790 A1 Jan. 17, 2013

Related U.S. Application Data

(60) Provisional application No. 61/323,232, filed on Apr. 12, 2010.

(51) Int. Cl.
*A61H 3/04* (2006.01)
*A45B 3/04* (2006.01)

(52) U.S. Cl.
CPC .. *A61H 3/04* (2013.01); *A45B 3/04* (2013.01); *A61H 2201/0173* (2013.01); *A61H 2201/0188* (2013.01); *A61H 2201/5007* (2013.01); *A61H 2201/5058* (2013.01); *A61H 2201/5064* (2013.01); *A61H 2201/5071* (2013.01); *A61H 2201/5079* (2013.01)

(58) Field of Classification Search
CPC ..... A45B 3/04; A61H 2201/0188; A61H 2201/5058
USPC ..... 135/65, 66, 910; 362/102
See application file for complete search history.

(56) References Cited

U.S. PATENT DOCUMENTS 5,489,951 A 2/1996 Hauser
5,575,294 A 11/1996 Perry et al.
6,930,603 B2 * 8/2005 Jackson ..... 340/539.12

(Continued)

OTHER PUBLICATIONS

International Search Report and Written Opinion under date of mailing of Jun. 30, 2011 in connection with PCT/US2011/032051.

*Primary Examiner* — David R Dunn
*Assistant Examiner* — Danielle Jackson
(74) *Attorney, Agent, or Firm* — Quarles & Brady, LLP

(57) ABSTRACT

An apparatus and a method for a walking aid are disclosed. The walking aid includes a walker having a frame configured to extend about a user of the walker to at least partially support the user and to facilitate the user progressing along a path from a current step to a next step while at least partially supported by the walker. A swivel mount is supported by the frame. A light source is connected to the swivel mount. The light source is configured to project a visual cue on a projection surface in the path between the current step and the next step to trigger the next step by the user. A controller is configured to adjust a visual property of the visual cue for use under indoor conditions and outdoor conditions.

17 Claims, 6 Drawing Sheets

(56) References Cited

U.S. PATENT DOCUMENTS

2006/0025836 A1 2/2006 Van Gerpen et al.
2006/0292533 A1* 12/2006 Selod ..... 434/247
2007/0034243 A1 2/2007 Miller
2007/0255186 A1 11/2007 Grill
2011/0118898 A1* 5/2011 Fu et al. ..... 701/1

* cited by examiner

-PRIOR ART-

SYSTEM AND METHOD FOR ALLEVIATING FREEZING GAIT AND GAIT HYPOKINESIA IN USERS WITH EXTRAPYRAMIDAL DISORDER

CROSS-REFERENCE TO RELATED APPLICATIONS

This application represents the national stage entry of PCT International Application No. PCT/US2011/032051 filed Apr. 12, 2011, which claims the benefit of U.S. Provisional Patent Application Ser. No. 61/323,232, filed on Apr. 12, 2010, both of which are incorporated herein by reference in their entirety for all purposes.

FIELD OF THE INVENTION

The present invention generally relates to generating a visual cue for a user of a walker, or walking aid device. One aspect of the invention is to provide a constant or recurring stimulus to reduce or substantially eliminate the occurrence of "Freezing of Gait" (FOG), gait hypokinesia, or stride reduction in a user, such as one suffering from parkinsonism.

BACKGROUND OF THE INVENTION

Parkinsonism is a debilitating syndrome, encompassing several neurological diseases that compromise the motor skills of its victims. Such diseases include Parkinson's Disease, vascular Parkinsonism, Normal Pressure Hydrocephalus (NPH), multiple systems atrophy (MSA), progressive supranuclear palsy (PSP), and others. Globally, Parkinsonism and other such diseases are referred to as extrapyramidal disorders. As parkinsonism progresses, one particularly debilitating problem is "Freezing of Gait" (FOG), in which an individual locks up or becomes so fixated they are unable to move or initiate further stepping movements by their own volition. In some cases the individual feels "stuck to the floor" as if by a magnetic force. Unfortunately, FOG is not responsive to available medications. As a result, FOG poses a significant risk of injury to individuals if they are left unattended, even when trying to perform the most mundane tasks, and especially when they are in public settings, such as trying to cross a street. Accordingly, individuals suffering from FOG require constant monitoring and assistance.

A related problem which often occurs concomitantly in patients with FOG is gait hypokinesia. Gait hypokinesia entails patients taking with FOG is gait hypokinesia. Gait hypokinesia entails patients taking increasingly smaller steps. In a similar fashion to FOG, gait hypokinesia is often refractory to medications. A result can be that patients ambulate so slowly that they become discouraged and may increasingly opt to use a wheelchair or motorized scooter. However, by being able to walk, patients can prevent muscle atrophy, maintain cardiovascular health and bone density, and preserve a positive psychological outlook. Moderate exercise, or walking, has also been shown to correlate with a decreased likelihood of developing cognitive impairment such as Alzheimer's disease.

The incidence of Parkinson's disease is reported as 1% of the population over the age of 50, and 1.5% over the age of 65, with some occurrence in younger individuals but negligible incidence in children. Over half a million people in the United States are afflicted with this condition. Parkinsonism has an even broader impact with an occurrence of 30% over age 75

(where vascular Parkinsonism as the most common) and at ages over 85, more than 50% suffer some form of Parkinsonism.

People have attempted to manage these FOG episodes in various ways. The management techniques usually involve playing a "trick" on the brain. One technique that some use is to march or rock to sound cues such as marching music or counting. Another method is to provide some visual cue that encourages the feet to step up and over, as if unsticking from glue, rather than stepping forward, as with regular walking. These tricks are usually taught in the physician's office by the doctors, nurses, and therapists who are familiar with the symptoms. People also learn the methods from reading books about Parkinson's disease or by attending support group meetings. Because actual visual cues are often impractical outside of a controlled and prepared environment, such as a therapist's office, some are taught to draw an imaginary line in front of the afflicted person's feet and encourage him or her to "step up and over the imaginary line." Also used is the dropping or placing of objects on the floor in front of the person's feet; forcing them to step over the object (paper, tissue, straws, belts, and the like). Virtually any object can be used to "step up and over." A number of these methods are disclosed in U.S. Pat. Nos. 5,575,294; 6,330,888; US 2004/0144411; US 2006/0292533; and US 2007/0255186.

FIG. 1 is an illustration of an example prior art system 10 for projecting a visual cue to alleviate FOG in an individual such as that described in U.S. Patent Publication No. 2006/0025836, hereby incorporated by reference. The device includes a battery pack or power source 20 that is connected to light source 15. Light source 15 is configured to project a visual shape or pattern. System 10 includes clip 25 for attaching light source 15 to a user or object. Generally, clip 25 is configured to attach to an article of the user's clothing, such as a belt, shoe, or waistband such that light source 15 directs the visual shape or pattern on the ground ahead of the user while the user walks.

Prior art projection systems such as that shown in FIG. 1 have several disadvantages. First, when attached to an article of the user's clothing, the position of light source changes as the user moves. Because the light source can shift around, at the time a user is affected by FOG, it is extremely unlikely that the light source will be correctly oriented to assist the user. Similarly, if the user is shaking or trembling, the light source will be affected by those movements, resulting in the visual pattern shaking violently over whatever surface the light source is oriented towards. Furthermore, because the pattern is projected some distance away from the light source, even the smallest movement of the user is magnified making the device extremely difficult to use.

Although the prior art systems may be attached to surfaces or objects that are relatively more stable, such as a cane, or walker, in order to provide a connection sufficient to fix the light source to the object safely, any such clip or attachment device must be extremely strong. Such a clip could be extremely difficult for an elderly person, or a person suffering from Parkinsonism or similar disease, to operate. As a result, conventional project systems such as that illustrated in FIG. 1 are of little benefit to a user suffering from FOG and gait hypokinesia. Furthermore, in many prior art devices the visual cue is directed an unhelpful position within the user's stride. Some devices, for example, generate a visual line that cannot be moved and projects onto a walking surface at approximately the level of a patient's heels.

The aforementioned systems have been helpful to people, but each has drawbacks. Sound cues (such as marching music) are not often feasible, particularly outside the home, and many find singing or counting aloud embarrassing. Dropping or placing items on the floor requires not only that you have the objects ready to use but that someone be available to place and retrieve the objects. One alternative to this is to use small disposable objects, such as cards, and leave the object(s) behind. With other objects, if the object is 3-dimensional, such as a belt, the individual could trip and fall. The imaginary line method works well, but again, someone usually must accompany the individual to draw the line with their foot or hand. Some patients find it difficult to imagine a line during the freezing episode and remain unable to move until involuntary release occurs.

The visual stimulations proposed also do not meet all of the needs of the user. The visual images are not adjustable in that they do not turn in the direction of the user's motion. Also, the challenges of different light conditions between indoors and outdoors are not addressed. Often, a Parkinsonian patient will just sit down and stop what he or she is doing. At the present time, these homemade tricks or clip-on devices are the only mechanical techniques available to individuals in the United States who suffer from freezing and gait hypokinesia. For many people, the above-listed techniques are too impractical to consider using consistently. Thus, there is a need for a system to assist sufferers of FOG, and gait hypokinesia that does not contain the above drawbacks.

SUMMARY OF THE INVENTION

The present invention is directed generally to a device and method for alleviating freezing of gait in a user, such as one suffering from parkinsonism or other extrapyramidal disorder. The device includes a light source, for example, a laser or LED, adjustably seated in a holder. The light source is focused into a visual cue. As the user steps toward the visual cue, the visual cue advances with the user, to create a continuing, successive stimulus for eliminating freezing for each step. If the user attempts to turn in a given direction, the device may actuate in such a way as to maintain the visual cue in front of the user.

In one implementation, the present invention includes a walking aid. The walking aid comprises a walker having a frame configured to extend about a user of the walker to at least partially support the user and to facilitate the user progressing along a path from a current step to a next step while at least partially supported by the walker, a swivel mount supported by the frame, and a light source connected to the swivel mount. The light source is configured to project a visual cue on a projection surface in the path between the current step and the next step to trigger the next step by the user. The walking aid further includes a controller configured to adjust a visual property of the visual cue for use under indoor conditions and outdoor conditions.

In other implementations, the present invention includes a walking aid. The walking aid comprises a walker having a frame configured to extend about a user of the walker to at least partially support the user and to facilitate the user progressing along a path from a current step to a next step while at least partially supported by the walker, and a light source connected to the frame and configured to project a visual cue on a projection surface in the path between the current step and the next step to trigger the next step by the user. The walking aid includes a processor connected to the frame and configured to determine an intended walking path of a user of the walker, the intended walking path deviating from the path, and position the visual cue in the intended walking path of the user.

In other implementations, the present invention includes a method of alleviating freezing of gait in a user of a walking aid. The method comprises detecting a differential weight input at a frame of the walking aid. The walking aid is configured to extend about a user to at least partially support the user and to facilitate the user progressing along a path from a current step to a next step while at least partially supported by the walking aid. The method includes using the differential weight input to determine a projected path of the user, and projecting a visual cue in the intended walking path of the user using a light source configured to project a visual cue on a projection surface in the path between the current step and the next step to trigger the next step by the user.

Other aspects and features of the present invention will become apparent in view of the figures and the following description.

DETAILED DESCRIPTION OF THE INVENTION

The present disclosure is directed to a device and method that may be used to alleviate "Freezing of Gait" (FOG) in a user suffering from parkinsonism or a similar neurological disorder. The device may also be used as a gait rehabilitation therapy to encourage a user suffering from gait hypokinesia that has decreased stride length to lengthen their stride. It has been known that some users of walkers may make sudden movements or leave their walker behind when rushing to make a turn. Therefore, the device may also be used to facilitate proper walker, or other walking aid, usage by encouraging the user to keep the walker properly situated in front of them in their direction of motion. Proper walker usage may also be improved with appropriate posture, which the present device can help to improve by encouraging a user to place their feet at an appropriate location beneath a walker. The device can also be used for fall prevention in that a user is encouraged to concentrate upon stepping in the appropriate places as directed by the light source, and therefore less likely to slip or inadvertently lose their footing.

The device and method of the present invention provide a visual cue to the user to cause or trigger an autonomic response. In one aspect, the visual clue is a line or other pattern projected onto a projection surface (e.g., a ground surface) orthogonal to the direction of motion of the user, typically on the floor or ground. The line may also be turned such that it is no longer lateral to the sides of the walker or walking aid, but is instead orthogonal to the newly intended direction of motion upon entering a turn. It has been found that such a line can trigger a response in parkinsonism sufferers to step on or across the visual cue, thereby eliminating the freezing for at least that step. Successive visual cues can be created as the user moves forward. The device and method of the present invention, therefore, use a visual cue to alleviate FOG. Although various examples of the present system and method are described in the present disclosure as alleviating FOG in an individual, it is to be understand that the present system may be generally used to alleviate FOG in addition to stride reduction or gait hypokinesia in an individual. As such, in the following discussion, references to FOG should be understood to apply equally to stride reduction and gait hypokinesia.

With this visual cue, fall prevention may also be facilitated by leaning forward to step on or over the visual cue. The user may be less prone to falls from auto-retropulsion a result of impaired postural reflexes which commonly affect patients with Parkinsonism.

Figure 2:
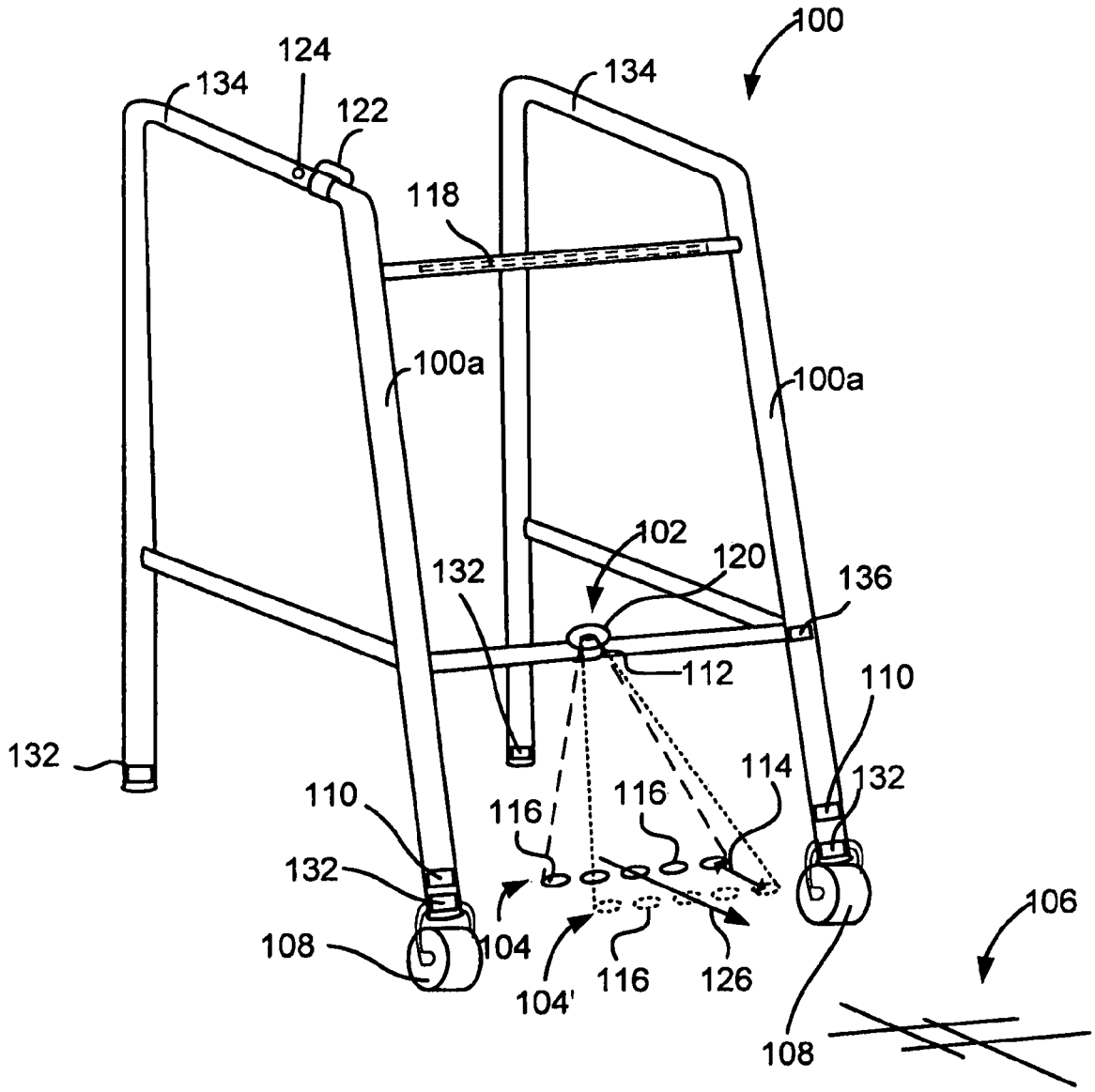
FIG. 2 is an illustration of the exemplary device of the present invention.

FIG. 2 depicts an embodiment of the present walker 100. Light source 102 is configured to project visual cue 104. Visual cue 104 is configured to spread out on the floor, ground surface, or another projection surface 106, ahead of or behind the front feet or wheels of walker 100 having front legs 100*a* and in the walking path of the user (indicated by arrow 126). Visual cue 104 may include a single solid projection, or several separate projections, such as projections 116 shown in FIG. 2. Although a single, solid projection may facilitate viewing, for battery saving purposes, a broken, or dashed visual cue 104 can be used.

Visual cue 104 is configured to move either forward or backward (e.g., from position 104 to position 104') by a distance 114 in such a way as to accommodate the preference of the walker's user, or to facilitate a particular treatment. That is, for fall prevention, for example, visual cue 104 can be positioned to be directed over a user's feet such that the user concentrates on where their feet have been or will be located. With gait training for example, the visual cue can be projected out ahead of the user to provide the user with a goal to lengthen the user's stride in order to reach the visual cue.

In some cases, walker 100 includes a controller (e.g., implemented by microprocessor 50 of FIG. 4) that automatically accommodates the user's stride length by monitoring a movement of walker 100 to characterize the stride length of the user. Then, based upon the determined stride length, the controller can select an appropriate position for the visual cue 104, for example by moving the visual cue from position 104 to position 104' as shown in FIG. 2, or to accommodate any other stride length appropriate for the user.

In one implementation, walker 100 includes a system such as an inertial measurement unit or system, or global position system (GPS) connected to the controller to detect movement (including both velocity and distance) of walker 100. Alternatively, in walkers that include wheels 108 (such as walker 100 illustrated in FIG. 2), walker 100 movement is detected using one or more wheel sensor 110 connected to either, or both, wheels 108. After collecting some movement data from walker 100 using any of the above measurement systems (either individually or in combination), the controller can than analyze the movement data to identify distances over which walker 100 is characterized by constant movement, followed by pauses, indicating that the user has taken a step. This information can be used to determine the stride length of the user, which can then be used to identify an appropriate positioning of visual cue 104 to achieve the optimum performance of walker 100, either by assisting the user in controlling stride length, or to direct visual cue 104 over the user's feet to assist in fall prevention, for example. After determining the stride length of the user, the controller moves visual cue 104 by an appropriate distance 114 to position visual cue 104 in the optimum location.

A bracket and clamp arrangement may secure light source 102 to walker 100. In the implementation shown in FIG. 2, light source 102 is coupled to walker 100 using universal swivel mount 112 that connects the light source to a mounting bracket allowing the light source to pivot. Swivel mount 112 may include a universal joint, such as a cardan joint, hardy-spicer joint, or hooke's joint. Alternatively, swivel 112 may include a ball and socket joint to allow for free movement of light source 102. As described below, a motor or other actuator may be coupled to swivel 112 for adjusting a position and orientation of light source 102.

The light source may be powered by any suitable energy source, for example, one or more batteries. Any size battery may be used as needed to supply sufficient power to the light source. Additionally, the battery or batteries may be rechargeable. Rechargeable batteries also may be used to stabilize voltage or current of the power source. If desired, a pressure sensitive ceramic, an electromechanical generating device, or a similar medium may be used to produce the necessary power for the light source. The power source may be enclosed in a housing or pack which may include a band, clip, or other fastener to secure the housing to a belt, walker, coat pocket, or the like.

In one implementation, energy source 118 is mounted within the frame of walker 100 and connected to light source 102. With the energy source mounted within the walker, the user of walker 100 is not required to carry a power source separately. As shown in FIG. 2, in one implementation, energy source 118 is mounted within a cross bar of walker 100. This configuration ensures a lateral weight balance between the left side and the right side of walker 100. By maintaining an evenly-balanced weight distribution, there is less danger that walker 100 will tip, particular when lifted by a user. In other implementations, however, the energy source may be mounted within walker 100 at any suitable location, even if to one side of walker 100, for example by being disposed within one leg of walker, or outside of the walker.

The light source may be a laser source (e.g., a type 3A, 635 nanometer laser (Laserex Model LDM-4-635-3-L30) emitting a red light configured in a line at three milliwatts, with the line being projected at a distance of 90 centimeters (cm) from the line's origin, with the line having a length of approximately 60 cm), such as a YAG or helium-neon laser, capable of high intensity, or a Krypton bulb source. The optical element(s) of the system may consist of any suitable combination of prisms, gratings, grisms, or collimators (see, for example optical element 120) that creates the desired pattern from the laser beam. Or the optical elements may be limited to a simple cast or molded shaped glass or plastic article having a shape that internally reflects light and serves as a beam-shaping waveguide body that spreads the round beam into a strip-like curtain and projects it as a collimated rectangular beam, so that no further optical elements are required for focus or shape adjustment. Another possibility is for an individual LED or group of LEDs to be used. However other optics, different patterns or pattern-defining elements, and other light sources may be used as well.

Light source 102 may also include a color which is easily discernable in both outdoor and indoor conditions or changeable for various lighting conditions. For example, in some circumstances, a green laser (e.g., having a wavelength of approximately 495-570 nanometers) shows up much more readily in outdoor day light, but can be overly bright for indoor conditions where a red laser (e.g., having a wavelength of approximately 620-750 nanometers) can be more efficacious. The light source can therefore be modifiable to contain a dual red/green laser system where the user can specify which they would like to use, or the device can automatically select which is appropriate based upon light conditions using a controller such as processor 50 (for automatic selection) or a manual switch such as switch 122 shown on FIG. 2). This same concept can be extended to LED or other light sources. In some implementations, the walker includes a light sensor (see, for example, sensor 136 of FIG. 2) to detect a level of ambient light. Based upon the light level (and, in fact, the spectrum of ambient light), the walker may be configured to select the most appropriate output light color for the light source. If, for example, the light sensor detects a high level of ambient light, a more intense, bright output color may be output by the light source at a higher power level. Conversely, in low ambient light conditions, the walker may select a different, more appropriate, color and output the light using less power.

A separate switch button 122 is positioned for ease of activation to turn the light source on and off. This switch may include a heat activated switch, a pressure activated switch, a timer switch, or some other form of tactile switch. Light emitting diode (LED) 124 may be provided to indicate whether the device is powered on. In one aspect, a pulsed LED is used to conserve power and increase battery life. Switch 122 can be a push button switch, and a set of rechargeable batteries from within the device provides the power supply. A timer connected to, for example, switch 122 of FIG. 2 may be configured so that, once the switch is pressed, the unit stays lit for a fixed short time interval, for example, two, five or ten seconds. Alternatively, the device may be provided with a motion or other sensor (not shown) that automatically turns the device off after a period of inactivity. Likewise, the device may be provided with a sensor that automatically turns the device on when motion is detected, for example using wheel sensors 110. In some such aspects, the sensor further may be adapted to detect motion in a desired direction or at a minimum height, such as detecting a forward motion or movement of the user using wheel sensors 110, so that motion caused by shaking of the user would not necessarily activate the device. A control may be included that blinks the power on and off during the actuation period. This may be useful either for charging a high power storage device to fire a strobe light (e.g., xenon flash source) to obtain higher intensity, in which case the unit serves to adapt a low voltage power source to a high intensity light source, or the source may blink simply to make the projected light pattern 104 more visually noticeable to enhance its effectiveness for overcoming a freezing incident.

Numerous mounting positions for light source 102 are possible on the body of the walker 100, and different forms of articulation or brackets may provide flexibility in aiming the device. Depending on the form of illumination employed, light source 102 may be mounted as shown in FIG. 2 on a front cross member, at a position low to the ground, to maximize the intensity of the projected image, or higher up on a side bracket or cross-piece or on a seat mounted to the walker. In embodiments where the projector is built into a leg or in a cross bar, it may have internal wiring to button 122 to allow a user to control the operation of light source 102. Alternatively button 122 may function wirelessly in order to be located at a more easily reached position for activating the projection controls for light source 102. Whether light source 102 is integral or added on, the frame of the walker 100 generally provides a fixed reference that allows light source 102 to be precisely and, in some cases, permanently aimed and focused on a ground surface in the correct position. In a walker with roller wheels, the activator button can be mounted adjacent to one of the hand brake control levers.

Figure 3B:
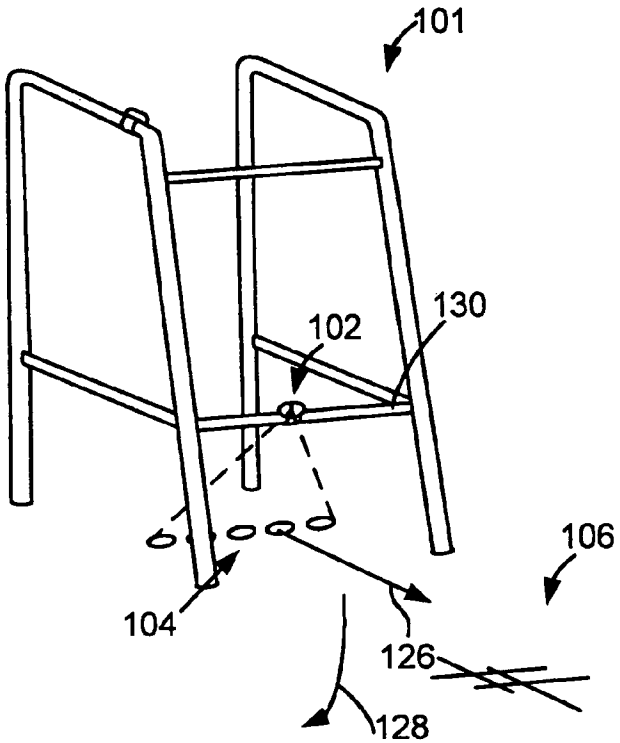
FIGS. 3A and 3B illustrate the exemplary device according to the present invention, after being angularly adjusted to match a user-initiated turn.
Figure 3A:
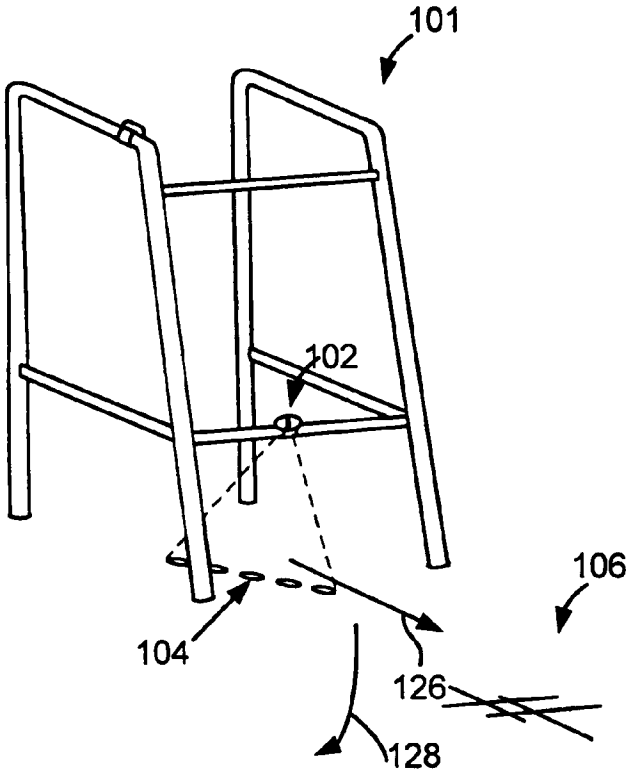

FIGS. 3A and 3B show alternative implementations of the device, wherein walker 101 is configured to direct visual cue 104 to different positions on a projection surface 106 (e.g., the ground) to assist a user in making a turn with walker 101. By adjusting the position of visual cue 104 on the ground or projection surface, the device can prompt a user to take a step where the stepping foot does not move along the user's previous walking path and, instead, is placed to one side of the walking path. For example, by moving visual cue 104 away from the walking path, a user can be prompted to take a step where the foot is place to one side of the walking path, thereby initiating a turn. By maintaining visual cue 104 in a displaced position, after taking a number of steps, the user can complete the desired turn.

Figure 1:
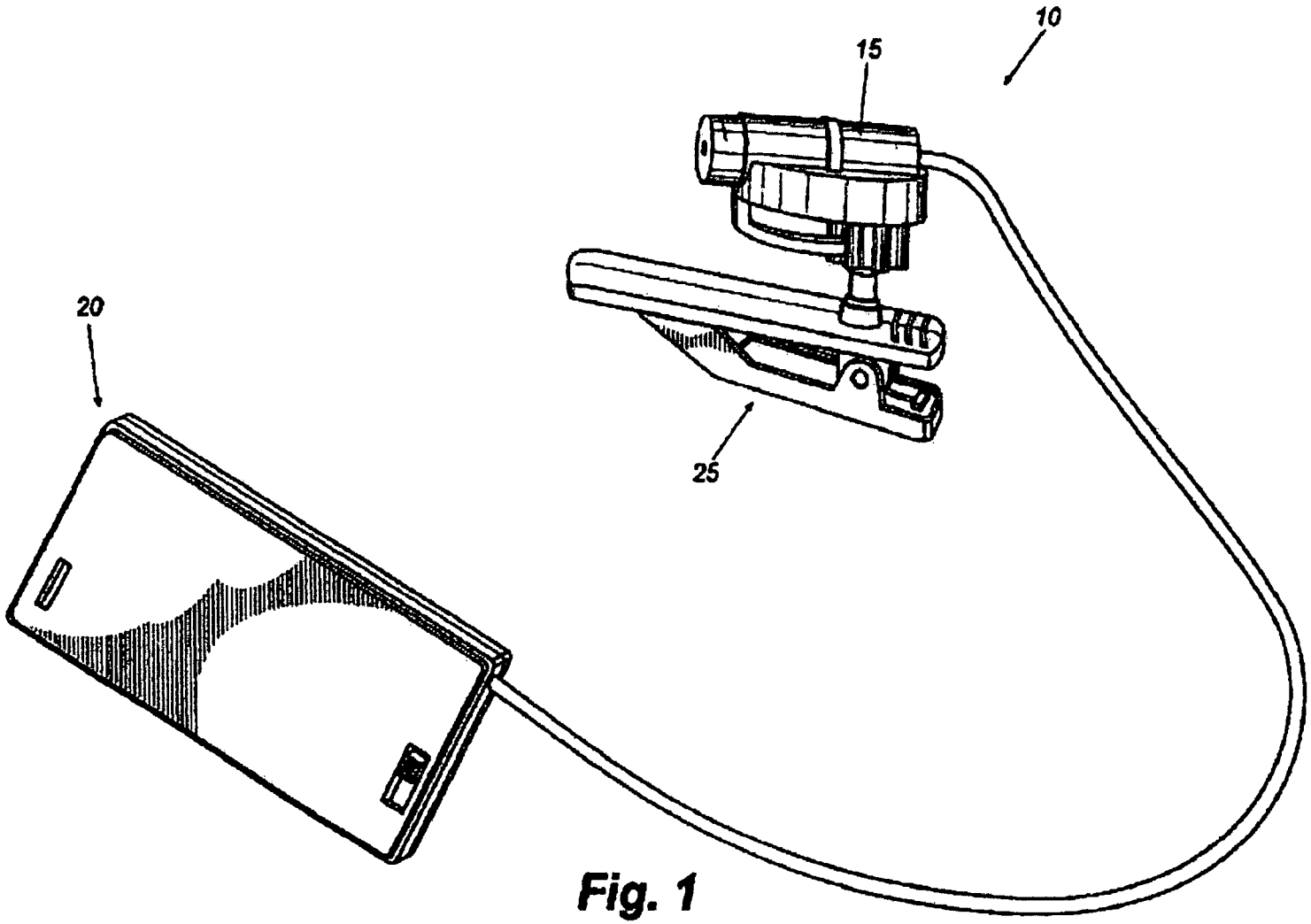
FIG. 1 depicts an example prior-art device comprising a light source connected to a clip for mounting the light source.

FIG. 3A depicts the light source 102 and visual cue 104 as the user initiates a right-hand turn (from the user's perspective) away from walking path 126 towards the turned walking path 128. As the user initiates a turn, light source 102 and visual cue 104 are rotated by rotation of light source 102 (e.g., by movement of universal bracket 112 of FIG. 1) through a predetermined arc in such a way as to aid the user in maintaining concentration on the visual cue. In one such embodiment, visual cue 104 may be represented by a line (or broken line) which is kept fixed at its right end as a pivot point, and the rest of the line is rotated clockwise around the right end. The pivot point could be changed; for example it could be in the middle of visual cue 104 or visual cue 104 could be rotated in some other fashion and this example is not intended to be limiting in any way. If the cue had remained stationary, the user may not have maintained concentration on the visual cue, or may not have received a benefit from the cue at all, and would therefore have suffered from FOG or another of the detriments that the device is designed to treat.

FIG. 3B depicts another embodiment of how the visual cue 104 could be moved while the user initiates a right-hand turn. In this embodiment, the visual cue is not rotated but is offset or translated in such a way as to move the cue to the right (in the direction of the turn 128) and away from the user's original path 126 (though it could also be moved towards the user if so desired). In the example shown in FIG. 3B, the translation can be achieved by a mechanism that moves light source 102 back and forth along the cross bar 130 of walker 101.

In both of the above embodiments depicted in FIGS. 3A and 3B, the universal swivel (see, for example, element 112 of FIG. 2) is actuated in such a way as to move the light source in order to rotate or move visual cue 104 into a displaced position along the new direction of travel when a user makes a turn. This can be accomplished in a number of possible ways. One way is for gyroscopes to be attached either to the device or the walker which will indicate when the direction of travel is changing, and will control the swivel either directly or through a computer processing means to move the visual cue. Another possibility is for pressure sensors to be mounted in the feet, legs, or handles of the walker such that when a person leans on one side of the walker thereby placing more pressure on one side of the walker's legs indicating the user is making a turn, the swivel will move the visual cue accordingly. Depending upon the implementation, the sensors may be placed in each leg of the walker, or in only two of the legs. Generally, any sensor system that allows for the determination of whether the user is pressing down more heavily on one side of the walker or the other can be used in conjunction with the present system. For example, sensors may be placed in the handles of the walker to detect a weight or pressure applied to the handles or the legs of the walker. In that case, although not measuring a weight or pressure applied to the legs directly, the handle sensors measure such a force indirectly.

With reference to FIG. 2, for example, pressure sensors 132 are disposed within each leg of walker 100. As shown in FIG. 2, pressure sensors 132 may be disposed proximate the feet, or wheels of the various legs of walker 100 to allow for accurate readings to be taken at each point walker 100 contacts ground surface 106. Alternatively, weight or pressure sensors may be mounted within handles 134 of walker 100 to detect a weight applied by the hands of the user.

Figure 4:
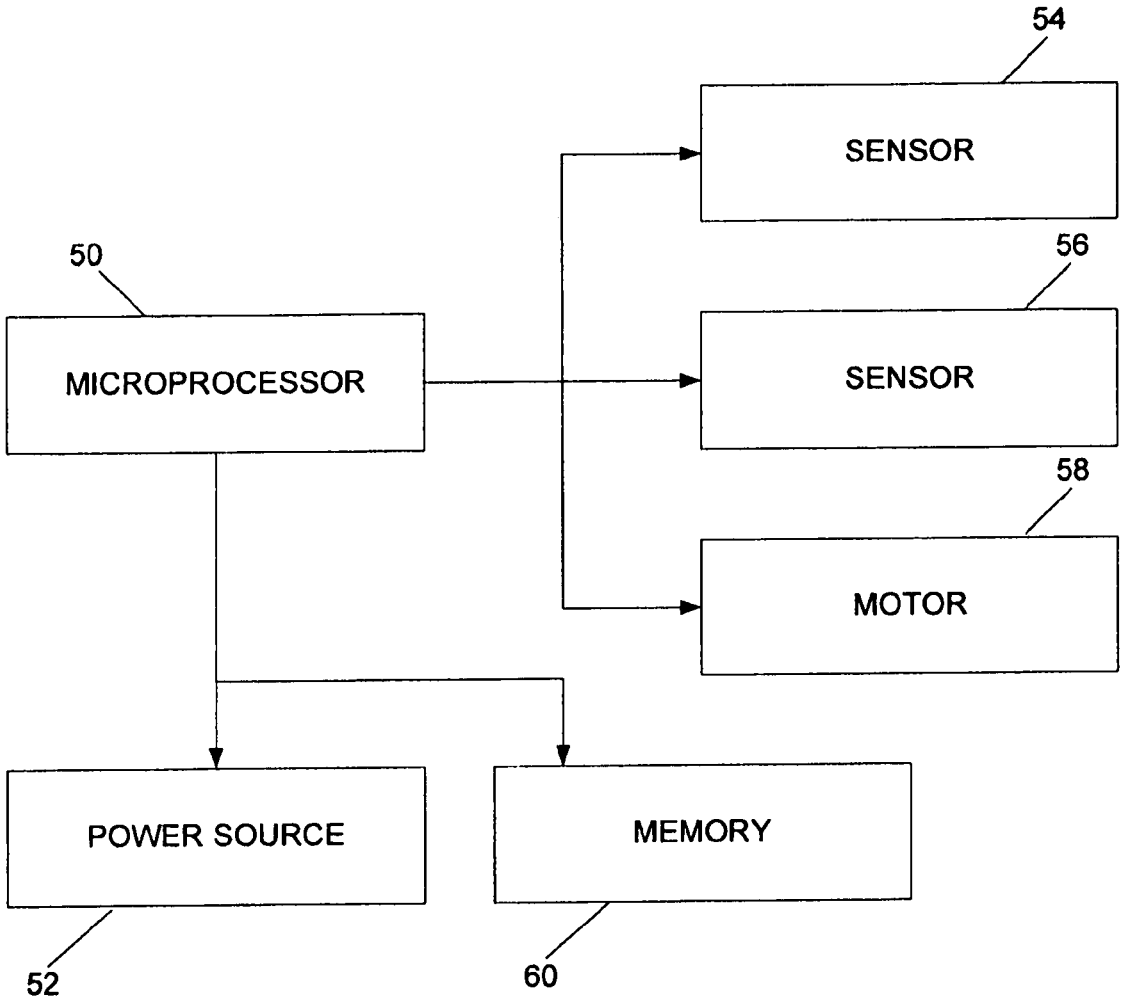
FIG. 4 is a diagram of the interrelated functional components of a walking aid that can be used to alleviate symptoms of, for example, FOG.

FIG. 4 is a block diagram illustrating the functional components of a walker configured to automatically adjust a position of the swivel to move the light source to facilitate the turning of a user. Microprocessor 50 is mounted on or within the walker and connected to power source 52 and memory 60. Microprocessor 50 is also in communication with sensors 54 and 56. In one implementation, sensor 54 is configured to detect a weight or pressure applied to a left side of the walker (e.g., through a handle or leg of the walker), while sensor 56 is configured to detect a weight or pressure applied to the right side of the walker. In other implementations, though, different combinations of sensors may be used for detecting a weight or pressure applied to any number of legs or handles of the walker.

Microprocessor 50 executes software that retrieves data from sensors. Using the data from sensors 54 and 56, microprocessor 50 determines whether a user is applying more weight to either the right or left side of the walker, or whether the walker is in balance. As such, microprocessor 50 can be configured to detect a differential weight input to the handles of the walker. If microprocessor 50 detects more weight to one side than another, the processor determines that the user is initiating a turn and instructs motor 58 to modify a position of the light source (e.g., light source 102 of FIGS. 2, 3A, and 3B) to assist in such a turn. The degree to which the light source is displaced can be at least partially determined by the degree of difference in pressure applied to one side of the walker versus the other.

Figure 5:
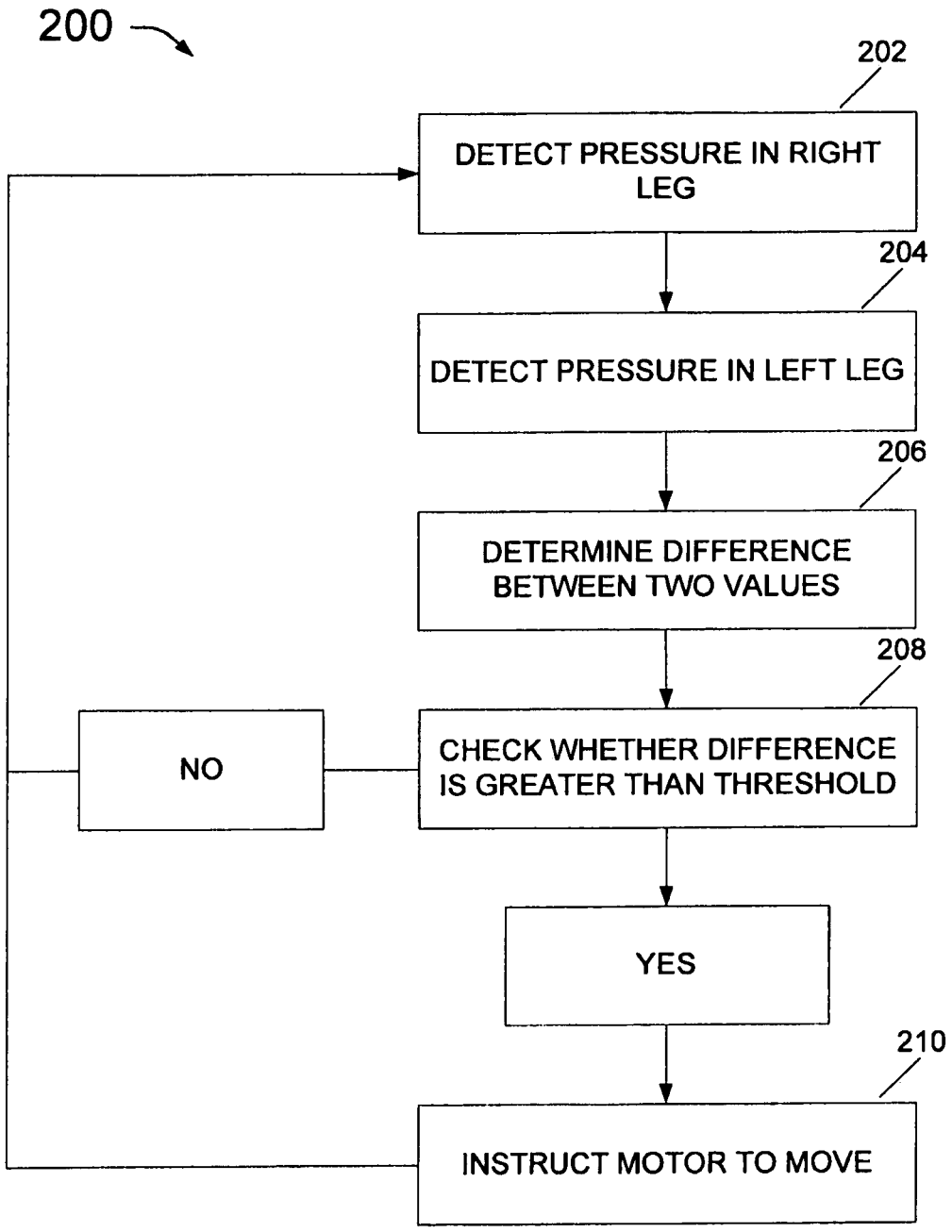
FIG. 5 is a flowchart illustrating a method for detecting that a user of the present system is initiating a turn.

FIG. 5 illustrates a method for directing the visual cue of the present system using pressure sensors mounted within a walker. Although method 200 is described in terms of a walker having two pressure sensors (see, for example, the block diagram of FIG. 4), with one configured to detect a weight applied to a left leg and one configured to detect a weight applied to a right leg, method 200 may be modified to work with walkers having other combinations of sensors.

Method 200 may be executed by a microprocessor mounted to or within a walker. In a first step 202, the microprocessor retrieves a measurement from a first sensor configured to detect a weight or pressure applied to one of the right legs of the walker. In step 204, the microprocessor retrieves a measurement from a second sensor configured to detect a weight or pressure applied to one of the left legs of the walker.

The processor then determines the difference between the two values in step 206. If the difference is greater than a predetermined threshold in step 208, then in step 210, the processor instructs a motor connected to the swivel mount to move the lighting device to a corresponding, predetermined position. The differences may have positive values, indicating the user is turning in a first direction, or negative values, indicating the user is turning in a second direction. Depending upon system requirements, many different thresholds can be defined, where thresholds having larger absolute values indicates sharper turns causing a greater displacement of the light source. After turning the light source, method 200 repeats. In some cases, extreme thresholds may be defined that indicate the weight differential is so great that the walker is in danger of tipping. In that case, if the weight differential exceeds the threshold, the walker may be configured to sound an alarm via a speaker connected to the frame of the walker to alert the user as to the possible tipping condition.

If the difference between the two sensor values does not exceed a predetermined threshold, then method 200 returns to step 202 and repeats.

After completing a turn, the user stops applying a differential pressure to the walker and both the right leg and left leg sensor detect the same pressure (or the same pressure within a predetermined error margin). In that case, the microprocessor causes the motor to return the light source to its non-displaced position. In some cases, therefore, if the answer to step 208 of FIG. 5 is no, the processor always causes the light source to return to its default position.

In some implementations, the sensor system includes memory 60 (shown on FIG. 4) for storing several sensor measurements made over a period of time such as the last 5 or 10 seconds. For example, the system may store sensor measurements every 1 second and store a maximum of 10 records. By recording several sensor measurements, the processor can compare the most current measurement to those made over some time to identify trends or anomalies. This may be used to alleviate problematic measurements resulting from a user of the walker momentarily striking or pushing down on one handle of the walker. Accordingly, the memory can be used to smooth out measurements. In one specific implementation, during the comparison step 208 shown in FIG. 5, before comparison, the processor may average the last 10 measurements for the left leg and the right leg sensor so that the processor compares only average measurement values, not the most recent values.

In some cases a user will naturally apply a different weight to the handles of the walker during use, even when walking in a straight line. As such, that user's normal operation, even when moving in a straight line, results in an unbalanced input at the walker's handles and, consequentially, the walker's legs. In that case, the walker may be configured to allow a user to establish a default position. The default would allow the user to define the unbalanced input as that user's normal, straight line input. Deviations from that input, then, could be used to identify when the user is initiating a turn and to determine appropriate positioning of the light source. The default may be stored in memory and used by the processor to compensate for a user's walking technique.

Yet another possibility is for the device to track where the user is looking, and move the visual cue according to where they are looking to move. If the user looks to the right, the visual cue will move or rotate to the right. If the user looks to the left, the visual cue will move or rotate to the left.

Figure 6:
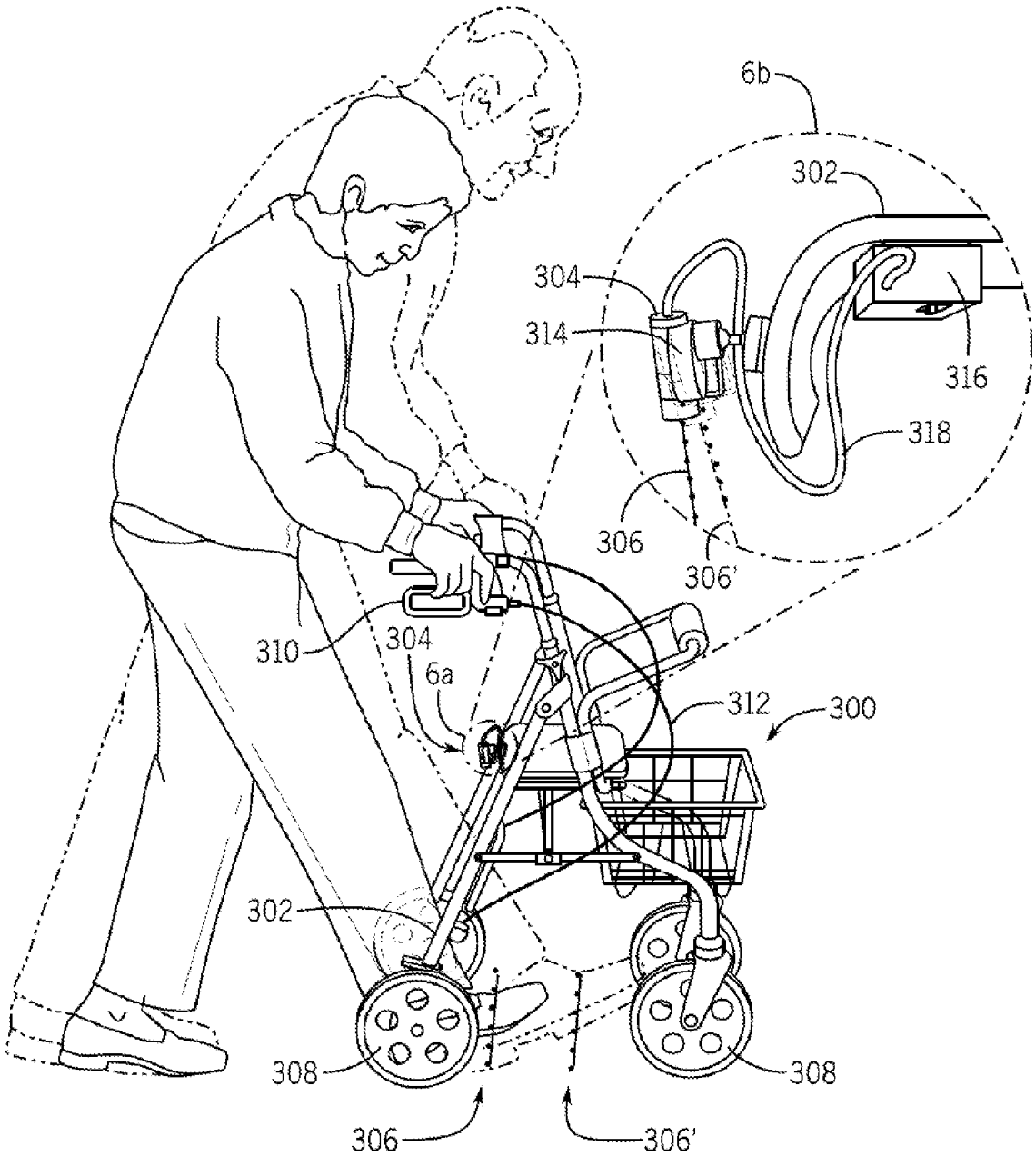
FIG. 6 is an illustration of an alternative implementation of the present walking aid device.

FIG. 6 is an illustration of an alternative implementation of the present walking aid. Walking aid 300 includes frame 302 configured to extend at least partially about a user and provide support to that user as he or she progresses along a walking path.

Light source 304 is connected to frame 302 of walker 300. Light source 304 is configured to project visual cue 306 into the walking path of the user, or over the feet of the user, as discussed above. As shown in FIG. 6, a position of visual cue 304 can be adjusted (e.g., from the position of visual cue 306 to the position of visual cue 306') to assist the user. The position may be selected to alleviate FOG, to assist in modifying the stride length of, or to mitigate gait hypokinesia in the user, again, as described above. As illustrated in FIG. 6, the position of visual cue 306 may be, at least in some part, determined by a height of the user of the walker 300.

Walker 300 includes a number of wheels 308 to facilitate movement of walker 300. Wheels 308 may be connected to wheel sensors, as described above, for monitoring a movement (e.g., speed and distance) of the walker for determining an appropriate position of visual cue 306 for the user. Wheels 308 are connected to braking levers 310 for controlling the rotation of wheels 308. Braking levers 310 are connected to the brakes of wheels 308 via cables 312.

Referring to FIG. 6, box 6*b* shows an enlarged portion of the region indicated by box 6*a* on FIG. 6. As shown in box 6*b*, light source 304 is connected to frame 302 of walker 300 via bracket 314. Bracket 314 may be configured in the same manner as universal swivel mount 112 of FIG. 2, for example. Alternatively, bracket 314 can include any light source 304 mounting system that can be adjusted to control a position of visual cue 306 on a project surface for a user. Also, as discussed above, bracket 314 (or light source 304) may be connected to a motor or other actuator for automatically modifying a position or orientation of light source 304 via a controller, such as a user interface (e.g., a switch or button) or via commands issued by a controller.

Light source 304 is connected to power or energy source 316 via cable 318. Energy source 316 may include a control switch that is configured to control power delivery to light source 304, or to otherwise control an operation of light source 304, for example by causing light source 304 to periodically flash, change color, modify a position of light source 304, or otherwise control an operation of light source 304. In that case, power source 314 may incorporate, or be in communication with a processor or controller (such as microprocessor 50 of FIG. 4) for determining an appropriate position of visual cue 306 and controlling at least one of a position and orientation of light source 304 to position visual cue 306 in, or proximate to, that determined location.

In the same manner as the prior art, the device could be used in conjunction with a belt, a hat, a shoe, a cane, or the like, or placed somewhere else on a user or a walking aid. Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

The invention claimed is:

1. A walking aid, comprising:

a walker having a frame configured to extend about a user of the walker to at least partially support the user and to facilitate the user progressing along a path from a current step to a next step while at least partially supported by the walker;

a swivel mount supported by the frame;

a light source connected to the swivel mount, the light source configured to project a visual cue on a projection surface in the path between the current step and the next step to trigger the next step by the user;

a controller configured to adjust a visual property of the visual cue for use under indoor conditions and outdoor conditions;

further comprising a motor connected to at least one of the swivel mount and the light source to modify at least one of a position and an orientation of the light source to modify a position of the visual cue on the projection surface with respect to the path;

further comprising a first sensor connected to the walker to detect a first pressure applied to the walker; and wherein, in response to the first pressure detected by the first sensor, the motor is configured to adjust the at least one of a position and an orientation of the light source to project the visual cue away from the path and toward a projected path.

2. The walking aid of claim 1, wherein the controller is configured to receive an indication of the first weight detected by the first sensor and, using the indication of the first pressure, determine the projected path implied by the first pressure and communicate the adjustment of the at least one of a position and an orientation of the light source to the motor to project the visual cue away from the path and toward the projected path.

3. The walking aid of claim 1, wherein the swivel mount is configured to automatically adjust a position of the visual cue in response to directional changes by the user and the walking aid includes at least one of a gyroscope, pressure sensor, and user eye tracking system configured to monitor directional changes by the user.

4. The walking aid of claim 1, further comprising a collimator disposed around the light source and configured to increase an intensity of the light source on a predetermined projection area.

5. The walking aid of claim 1, wherein the light source is configured to generate first and second visual cues.

6. The walking aid of claim 5, further comprising a light sensor connected to the frame and configured to detect an ambient light level about the walker, and wherein the controller is configured to use the ambient light level to select one of the first visual cue and the second visual cue for outputting by the light source.

7. The walking aid of claim 5, wherein the first visual cue is configured for indoor use and the second visual cue is configured for outdoor use.

8. The walking aid of claim 7, wherein the first visual cue consists of a light having a wavelength between approximately 620 nanometers and approximately 750 nanometers and the second visual cue consists of a light having a wavelength between approximately 495 nanometers and approximately 570 nanometers.

9. A walking aid, comprising:

a walker having a frame configured to extend about a user of the walker to at least partially support the user and to facilitate the user progressing along a path from a current step to a next step while at least partially supported by the walker;

a swivel mount supported by the frame;

a light source connected to the swivel mount, the light source configured to project a visual cue on a projection surface in the path between the current step and the next step to trigger the next step by the user;

a controller configured to adjust a visual property of the visual cue for use under indoor conditions and outdoor conditions;

further comprising a motor connected to at least one of the swivel mount and the light source to modify at least one of a position and an orientation of the light source to modify a position of the visual cue on the projection surface with respect to the path;

further comprising a first sensor connected to the walker to detect a first pressure applied to the walker;

further comprising a second sensor connected to the walker at a position displaced from the first sensor to detect a second pressure applied to the walker at the position displaced from the first sensor;

wherein the controller is configured to receive an indication of the first pressure detected by the first sensor and an indication of the second pressure detected by the second sensor and determine a differential therebetween and, using the differential, determine a projected path implied by the differential and communicate an adjustment of the at least one of a position and an orientation of the light source to the motor to project the visual cue away from the path and toward the projected path.

10. The walking aid of claim 9, wherein the controller is configured to:

compare the differential to a predetermined threshold; and when the differential exceeds the predetermined threshold, communicate the adjustment of the at least one of a position and an orientation of the light source to the motor.

11. A walking aid, comprising:

a walker having a frame configured to extend about a user of the walker to at least partially support the user and to facilitate the user progressing along a path from a current step to a next step while at least partially supported by the walker;

a light source connected to the frame and configured to project a visual cue on a projection surface in the path between the current step and the next step to trigger the next step by the user; and a processor connected to the frame and configured to:

determine an intended deviation from the path of the user of the walker, and position the visual cue in the intended deviation from the path of the user of the walker by altering the position of the light source with respect to the frame of the walker.

12. The walking aid of claim 11, wherein determining the intended deviation from the path of the user includes:

receiving an indication of a pressure differential applied to the frame of the walker;

using the indication of the pressure differential to determine a projected path implied by the differential; and adjusting a position of the visual cue to position the visual cue away from the path and toward the projected path.

13. The walking aid of claim 11, wherein the light source is configured to generate first and second visual cues.

14. The walking aid of claim 13, further comprising a light sensor connected to the frame and configured to detect an ambient light level about the walker, and wherein the processor is configured to use the ambient light level to select one of the first visual cue and the second visual cue for outputting by the light source.

15. A method of alleviating freezing of gait in a user of a walking aid, comprising:

detecting a differential pressure input at a frame of the walking aid, the walking aid configured to extend about a user to at least partially support the user and to facilitate the user progressing along a path from a current step to a next step while at least partially supported by the walking aid, the walking aid including a light source configured to project a visual cue on a projection surface in the path between the current step and the next step to trigger the next step by the user;

using the differential pressure input to determine a projected path of the user; and projecting a visual cue in the projected path of the user by altering the position of the light source with respect to the frame of the walking aid.

16. The method of claim 15, wherein the light source is configured to generate first and second visual cues.

17. The method of claim 16, further comprising:

detecting an ambient light level about the walking aid; and using the ambient light level to select one of the first visual cue and the second visual cue for outputting by the light source.

* * * * *